US011400025B2

(12) United States Patent
Roehrig

(10) Patent No.: US 11,400,025 B2
(45) Date of Patent: Aug. 2, 2022

(54) CONTAINER

(71) Applicant: MAM BABYARTIKEL GESELLSCHAFT M.B.H., Vienna (AT)

(72) Inventor: Peter Roehrig, Vienna (AT)

(73) Assignee: MAM BABYARTIKEL GESELLSCHAFT M.B.H., Vienna (AT)

( * ) Notice: Subject to any disclaimer, the term of this patent is extended or adjusted under 35 U.S.C. 154(b) by 1 day.

(21) Appl. No.: 15/762,344

(22) PCT Filed: Sep. 23, 2016

(86) PCT No.: PCT/AT2016/060071
§ 371 (c)(1),
(2) Date: Mar. 22, 2018

(87) PCT Pub. No.: WO2017/049331
PCT Pub. Date: Mar. 30, 2017

(65) Prior Publication Data

US 2018/0296443 A1 Oct. 18, 2018

(30) Foreign Application Priority Data

Sep. 23, 2015 (AT) ..... A 50812/2015

(51) Int. Cl.
*A61J 11/04* (2006.01)
*B65D 41/06* (2006.01)
(Continued)

(52) U.S. Cl.
CPC ..... *A61J 11/04* (2013.01); *A61J 9/04* (2013.01); *A61J 9/08* (2013.01); *A61J 11/008* (2013.01); *B65D 41/06* (2013.01)

(58) Field of Classification Search
CPC .... B65D 50/046; B65D 50/041; B65D 41/06; B65D 41/0471; B65D 41/04; B65D 1/0246; B65D 1/023; A61J 11/04
(Continued)

(56) References Cited

U.S. PATENT DOCUMENTS 826,796 A 7/1906 McManus
2,013,527 A 9/1935 Sherman
(Continued)

FOREIGN PATENT DOCUMENTS

CA 2 752 918 A1 8/2011
CN 101460370 B 3/2011
(Continued)

OTHER PUBLICATIONS

International Search Report with regard to PCT/AT2016/060071 dated Jan. 20, 2017.
(Continued)

*Primary Examiner* — Anthony D Stashick
*Assistant Examiner* — Raven Collins
(74) *Attorney, Agent, or Firm* — Greenblum & Bernstein, P.L.C.

(57) ABSTRACT

A container including at least one connection opening and at least one connection part, wherein grooves and engaging elements are provided as interacting connection elements to connect the container and the connection part, and in the connected state a respective engaging element is arranged in a receiving portion of a groove, which receiving portion is arranged substantially perpendicular to a longitudinal axis of the container, wherein the container and the connection part have run-on elements with run-on surfaces which run obliquely with respect to the longitudinal axis of the container, which run-on surfaces interact by means of rotational movement between the container and the connection part, in
(Continued)

such a way that the engaging elements can be moved out of the receiving portion of the respective groove and, in a rotated position, the engaging connection between the container and the connection part is released.

24 Claims, 14 Drawing Sheets

(51) Int. Cl.
*A61J 9/08* (2006.01)
*A61J 9/04* (2006.01)
*A61J 11/00* (2006.01)

(58) Field of Classification Search
USPC ..... 220/302, 297, 300, 301, 293, 288, 326, 220/324, 625; 215/330, 332, 218, 221, 215/222, 217, 329, 44, 43, 287, 280, 216
See application file for complete search history.

(56) References Cited

U.S. PATENT DOCUMENTS

| | | | | |
|---|---|---|---|---|
| 3,435,975 | A | 4/1969 | Weigand | |
| RE30,625 | E * | 5/1981 | Akers | B65D 41/065 215/211 |
| 4,373,641 | A * | 2/1983 | Banich, Sr. | B65D 41/04 215/331 |
| 4,383,619 | A | 5/1983 | Mumford et al. | |
| 4,387,817 | A | 6/1983 | Wiles et al. | |
| 4,640,430 | A * | 2/1987 | Haines | B65D 41/04 215/330 |
| 5,449,077 | A | 9/1995 | Seidler | |
| 5,685,445 | A * | 11/1997 | Dobbs | B65D 41/0471 215/330 |
| 6,109,466 | A * | 8/2000 | Carrier | B65D 41/0471 215/330 |
| 7,182,213 | B2 * | 2/2007 | King | B65D 41/045 215/330 |
| 7,857,153 | B2 | 12/2010 | Ito et al. | |
| 7,866,495 | B2 | 1/2011 | Roehrlg | |
| 8,028,848 | B2 * | 10/2011 | Pugne | B65D 55/022 215/330 |
| 8,091,724 | B2 * | 1/2012 | King | B65D 1/0246 215/330 |
| 8,636,160 | B2 | 1/2014 | Park | |
| 10,399,728 | B2 * | 9/2019 | Brozell | B65D 1/0246 |
| 2004/0007556 | A1 | 1/2004 | Manera et al. | |
| 2005/0258123 | A1 | 11/2005 | Silver | |
| 2007/0144999 | A1 * | 6/2007 | King | B65D 41/04 215/330 |
| 2008/0314860 | A1 * | 12/2008 | Pugne | B65D 55/022 215/330 |
| 2010/0025355 | A1 | 2/2010 | Beecroft | |
| 2011/0031209 | A1 * | 2/2011 | Arecco | B65D 47/122 215/330 |
| 2011/0100945 | A1 * | 5/2011 | Gutierrez | A61J 9/00 215/11.5 |
| 2012/0234790 | A1 | 9/2012 | Gollan | |
| 2012/0261378 | A1 | 10/2012 | Acedo | |
| 2013/0334164 | A1 * | 12/2013 | Kassouni | B65D 41/0471 215/330 |
| 2013/0341297 | A1 | 12/2013 | Stephan et al. | |
| 2015/0266630 | A1 * | 9/2015 | Scott | B65D 41/0414 220/296 |

FOREIGN PATENT DOCUMENTS

| | | | |
|---|---|---|---|
| DE | 202012100829 | | 5/2012 |
| DE | 202012100829 | U1 | 7/2012 |
| EP | 0 208 390 | | 1/1987 |
| EP | 177 9833 | | 5/2007 |
| EP | 1779833 | A1 | 5/2007 |
| EP | 2 368 809 | | 9/2011 |
| FR | 2 157 029 | | 6/1973 |
| FR | 2 715 062 | | 7/1995 |
| JP | S49-74392 | U | 6/1974 |
| JP | S52-57045 | U | 4/1977 |
| JP | S59-32646 | U | 2/1984 |
| JP | S59-172150 | U | 11/1984 |
| JP | S 62-1526 | A | 1/1987 |
| JP | 2007-508873 | A | 4/2007 |
| JP | 2014-106892 | A | 6/2014 |
| WO | WO 94/13547 | | 6/1994 |
| WO | WO 2005/041851 | | 5/2005 |
| WO | WO 2008/079282 | | 7/2008 |
| WO | 2015/142279 | | 9/2015 |
| WO | WO 2017/049331 | | 3/2017 |

OTHER PUBLICATIONS

Chinese Office Action dated Mar. 1, 2019 in Chinese Patent Application No. 201680062278.9.
Canadian Office Action dated Jul. 9, 2019 in the Canadian Patent Application No. 2,999,536.
Japanese Office Action dated May 13, 2019 in the Japanese patent Application No. 2018-515241 with English Translation.
Israel Office Action dated Feb. 9, 2022 in Israel patent application No. 258289, including English language translation.

* cited by examiner

CONTAINER

BACKGROUND

1. Field of the Invention

The invention relates to a container with at least one connection opening and at least one connection part, wherein grooves and engaging elements are provided as interacting connection elements to connect the container and the connection part, wherein in the connected state an engaging element is arranged in each case in a receiving portion of a groove, which receiving portion runs essentially perpendicular to a longitudinal axis of the container.

2. Description of the Background

Containers of the aforementioned kind are in principle already known from the prior art, wherein for example a closure cap can be fastened either by means of a snap connection by a longitudinal movement applied in the axial direction of the container or alternatively, however, by means of a bayonet connection. Thus, such a container closure is known in particular in WO 94/13547 A1. It should however be noted here that, depending on which type of connection is intended to produce a connection, the alignment of the container neck with respect to the closure cap has to be correspondingly selected, i.e. for the joining by means of the bayonet connection, it is necessary to align the connection elements to be introduced into the bayonet tab in alignment with the end portion of the bayonet tab running in the longitudinal direction of the container. On the other hand, to produce the snap connection, it is necessary for the detent catches not to be arranged either in the region of the longitudinal groove of the bayonet connection or in a stop region between the longitudinal groove and the transversely running fastening portion of an adjacent bayonet tab, since a snap connection is not possible in this region.

Furthermore, a closure system of a container with a cap is known from US 2012/0261378 A1. Here, an annular collar of the container comprises two primary anchors lying opposite one another and two secondary anchors offset respectively by 90°. The primary anchors are constituted in the form of a bayonet connection with a vertical portion and a horizontal portion. Parallel to the vertical portion, a securing projection is provided adjacent to an inclined end piece of the horizontal portion, said securing projection being flatter than the two portions. Consequently, an insertion/rotation movement is required here in order to close the bayonet connection.

Further containers are known from EP 2 368 809 A1, which comprise flanges extending inwards into the cap, which flanges can be snapped onto corresponding flanges projecting outwards on the container. A snap connection is not possible, however, when the flanges of the cap are arranged precisely in the intermediate spaces between the flanges of the container. In this position, the cap can only be secured on the container by rotation—corresponding to the closing of the bayonet connection.

A medicament container with an elastic inner cap and an outer cap is also known from U.S. Pat. No. 4,383,619 A, wherein projections provided in the outer cap are engaged in the closed state with notches correspondingly provided on the container in the manner of a bayonet connection. To open the outer cap, the collar provided in the outer cap must be pressed against the inner cap and the latter deformed in order that the projections can be rotated out of the notches.

In connection with baby bottles, a baby bottle is known in particular from WO 2005/041851 A, which is constituted open in an upper and lower end region, wherein the lower container opening is provided for receiving a bottom cap for the purpose of forming a bottom valve and the upper container opening is provided for fastening a teat in a manner known per se with the aid of a sleeve cap. This baby bottle functions basically without problem, wherein conventional threaded connections are provided here both for fastening the sleeve cap as well as for the fastening of the bottom cap. Accordingly, both hands are required here to produce the connection, i.e. the mother on the one hand has to hold the bottle jacket and then has to perform a rotational movement of the bottom or sleeve cap with respect to the bottle jacket.

SUMMARY

The aim of the present invention, therefore, is to create a container of the type mentioned at the outset, wherein in particular the fastening procedure of a connection part, in particular of a bottom cap or sleeve cap, is simplified, in particular a single-handed operation is possible.

According to the invention, the aim is achieved by a container with the features of the invention according to claim 1.

According to the invention, therefore, the container and the connection part comprise run-on elements with run-on surfaces which run obliquely with respect to the longitudinal axis of the container and which interact by means of a rotational movement between the container and the connection part in such a way that the engaging elements can be moved out of the receiving portion of the respective groove and, in a rotated position, the snap-in connection between the container and the connection part is released.

According to the invention, therefore, a container is provided, wherein a connection part can be obtained by means of a snap or snap-in connection by bringing together the connection part and the container essentially in the direction of the longitudinal axis of the container. A connection of the container and the connection part by means of a single-handed operation is thus possible. For the release of the connection part from the container, on the other hand, a rotational movement is required, so that the engaging elements (snap-in elements) can each be released from their snapped-in position in the respective groove with the aid of interacting run-on surfaces and the container and the connection part can thus be separated from one another.

In order to ensure that a snap connection can be obtained independently of the rotational alignment between the container and the connection part, i.e. a special rotational alignment of the two parts with respect to one another does not have to be present in order to produce a connection via the snap connection, it is advantageous if a guide element preventing the connection part and the container from being brought together in the direction of the longitudinal axis is provided in a portion between adjacent grooves or in an end portion of the grooves, so that a rotation of the connection part and the container with respect to one another is brought about when the connection part and the container are brought together in the direction of the longitudinal axis of the container.

Insofar as it were possible to bring together the connection part and the container in the direction of the longitudinal axis of the container in a portion between adjacent grooves or in an open end portion of the groove (insofar as a groove in the manner of a bayonet connection is present), only a displacement in the longitudinal direction would take place with a single-handed operation without the container and the connection part effectively being connected together. To prevent this, in the case of a corresponding alignment of the engaging elements with respect to the grooves, a rotation is brought about by means of the guide element during a movement of the connection part in the longitudinal direction, so that the engaging elements of the connection part come to lie in the longitudinal direction above or below the receiving portion of the groove that runs essentially transversely to the longitudinal axis of the container, before the container and the connection part are then reliably connected together by means of a snap connection.

With regard to a structurally simple embodiment, in which no further measures have to be taken on the container side in order to prevent a reliable snap-in connection not being achieved when the container and the connection part are brought together in the longitudinal direction of the container, i.e. in the manner of a plug-in connection, it is advantageous if the run-on element of the connection part interacts with the guide element of the container when the connection part and the container are brought together in the direction of the longitudinal axis with lined-up alignment with respect to one another, in such a way that a rotation of the connection part and the container with respect to one another is brought about.

In order reliably to achieve a rotation of the container and the attachment part, insofar as the guide element is active when the container and the connection part are brought together, it is advantageous if the guide element comprises at least one guide flank running obliquely with respect to the longitudinal axis of the container.

Furthermore, it is advantageous if contact faces of the engaging elements and/or of the grooves comprise undercuts at least in some sections. Such undercuts can preferably form an angle of approximately 5°-15° with respect to a right angle to the faces from which the engaging elements project or into which the grooves extend, so that an undesired release of the snap connection is reliably prevented even in the presence of fairly great tractive forces acting in the longitudinal axis of the container.

If the grooves comprise a ramp-shaped end portion connecting the receiving portion of the respective groove with a portion between two grooves that is flush with the remaining outer surface of the container in the mouth region, the engaging elements can each come to lie in the flush portion between adjacent grooves in the rotated position, so that the snap-in connection is thus released and the connection part and the container can easily be separated from one another.

With regard to a structurally simple embodiment, with which a reliable connection between the connection part and the container can at the same time be ensured, it is advantageous if the engaging elements are spring-mounted.

In order to enable sufficient deformability of the engaging elements and at the same time, however, to produce reliably a connection with the container by means of the engaging elements in the snapped-in position, it is advantageous if the grooves are arranged at the outer side of a cylindrical jacket surface of the container and the engaging elements are arranged at the inner side of wall portions of the connection part, the connecting lines whereof in their unstressed position have a course diverging from a circular shape, wherein the wall portions are elastically deformable, in such a way that the engaging elements can in each case be snapped over the web. As a result of the course of the wall portions carrying the engaging elements, said course diverging from a circular shape, in particular an approximately polygonal course, corresponding to the number of engaging elements, preferably an approximately square course, it can be ensured that the wall portions carrying the engaging elements essentially adapt to the circular shape of the container carrying the grooves during the joining-together. The engaging elements can then snap into the respective grooves, wherein the wall portions in the snapped-in position are then tensioned, so that a reliable connection between the attachment part and the container is ensured.

According to an example of embodiment of the invention, the interacting connection elements comprise grooves in the manner of a bayonet connection, wherein the engaging elements can be snapped in over a web adjacent to the respective groove essentially in the direction of the longitudinal axis of the container into the closure position, and can be removed from the respective groove through an opening. With this embodiment, an end portion of the groove, which is constituted in the manner of a bayonet connection, advantageously comprises in each case a run-on surface, so that, when the attachment part and the container are rotated, the engaging elements are moved in the direction of an opening of the respective groove.

In order to enable the user to make a connection of the connection part and the container in the usual way by means of a rotational movement, it is advantageous if the interacting connection elements can be connected to one another, as an alternative to a snap connection, by means of an insertion/rotation movement, wherein the engaging element can be introduced in each case via the opening into the receiving portion of the respective groove. If the user thus has both hands available, a reliable connection between the container and the connection part can also be produced according to an embodiment in the usual way—in the same way as with known screw connections—by introducing the engaging elements into the respective groove of the bayonet connection, i.e. first into the end portion bringing about a displacement in the longitudinal direction, and then by a rotation in the direction of the receiving portion constituted essentially pocket-like. The release of the connection between the container and the connection part is easily possible in a manner known per se by means of rotation and subsequent displacement essentially in the longitudinal direction out of the groove of the bayonet connection. A sleeve cap of a baby bottle in particular as well as a bottom cap of a baby bottle can come into consideration as attachment parts.

On the other hand, as an alternative to the aforementioned option, it may also be desired to offer only a single closure variant, i.e. the one by means of a snap connection. In this case, it is advantageous if the opening comprises in each case a stop preventing the introduction of an engaging element. For the release of the connection between the connection part and the container, a rotational movement and withdrawal of the engaging elements via the respective opening in the groove is of course also necessary with this variant.

If the guide element comprises a tip viewed in the direction of the longitudinal axis of the container, which tip is preferably rounded off and which is adjoined by guide flanks on both sides, wherein one guide flank connects to the web adjacent to the groove and the other guide flank in each case ends adjacent to an opening, it is reliably ensured that the connection part and the container are aligned with one another in such a way that a snap connection reliably takes place when the connection part is put on in the longitudinal direction. In other words, this means that an introduction into the end portion of the bayonet groove in the case of a single-handed operation, i.e. with a movement essentially in the longitudinal direction of the container, by means of which no effective connection between the connection part and the container would be produced, is reliably prevented.

In an example of embodiment, the guide element thus preferably comprises an essentially triangular shape, so that—insofar as an engaging element is advanced in the longitudinal direction towards the container—the engaging element possibly makes contact with the tip and a stable support is not therefore made, so that a rotation of the connection part with respect to the container along an obliquely arranged guide flank is reliably achieved.

In order to prevent blocking particularly reliably when the connection part and the container are brought together in the longitudinal direction of the container, it is further advantageous if the engaging elements essentially comprise a triangular shape with a preferably rounded-off tip that strikes the tip of the respective guide element during the approach of the connection part towards the container with a corresponding rotational alignment. By means of the engaging element also constituted in a triangular shape, the probability that a tip of the engaging element will strike a tip of the guide element is markedly reduced compared to embodiments with a larger area. In addition, both tips of the respective guide and engaging elements thus do not comprise stable contact faces, so that a rotation of the container and the connection element away from the opening constituted in the longitudinal direction is reliably ensured.

Proceeding from the opening, each groove advantageously comprises an end portion which runs in such a way that an engaging element received therein is guided obliquely to an orthogonal plane to the longitudinal axis of the container, and which connects to the receiving portion, which is bordered on one side by the web preferably running along an orthogonal plane to the longitudinal axis of the container. With the aid of such an end portion guided obliquely in this way, the closing procedure is simplified for the user, since only placing on and then a rotational movement, to which the user especially of baby bottles with conventional screw connections is usually accustomed, are required in order reliably to achieve an effective connection between the container and the connection part.

The risk of a pseudo fastening, i.e. a connection between the container and the connection part which gives the user the impression that the two parts are successfully connected to one another, but in reality only a loose connection is present, is advantageously reduced by the fact that the web bordering the groove comprises a recess in a portion bordering the opening of an adjacent groove, at the side from which the connection part is advanced towards the container for the connection. With the aid of the recess, the groove of the bayonet connection thus comprises a kind of receiving pocket in the region of the opening, so that, if an engaging element should come into contact in this region, a rotation into the opening is prevented. Snapping-in then takes place with further application of force in the longitudinal direction of the container.

In order to secure the engaging elements against rotation in the receiving portion of the groove, it is advantageous if, in the transition region between the end portion and receiving portion of the groove, a securing web running transversely with respect to the longitudinal extension of the groove is provided in each case. The effect of this, therefore, is that an increased rotational force has to be applied to overcome the securing web. At the same time, it becomes clear to the user by the fact that the securing web has been overcome that the connection has been released.

If a bottle body is provided as a container and a sleeve cap for fastening a bottle teat is provided as a connection part, an effective connection can be produced between these parts in a reliable and straightforward manner by a single-handed operation. Since users of baby bottles, in particular, usually have only one hand available, the embodiment according to the invention is therefore of great practical use, especially in connection with baby bottles.

It emerges here that the possibility of producing a connection in association with baby bottles by means of a single-handed operation is particularly advantageous for fastening the bottle teat and also a bottom valve. Insofar as the bottle body thus comprises two connection openings lying opposite one another, the bottle teat can be fastened to an upper connection opening and a connection part constituted as a bottom cap with an air intake valve can be fastened to a bottom connection opening.

In order to ensure that a teat is reliably held by means of the snap or bayonet connection between the sleeve cap and the bottle body and there is therefore no risk of the bottle teat being undesirably pulled out of the connection, it is advantageous if the sleeve cap comprises at least one projecting web, preferably subdivided into four portions, in an annular cap portion at an underside facing towards the container in the assembled position. With the aid of such projecting web portions, a bottle teat comprising at least one projection engaging behind the projecting web portions can thus be reliably secured in the manner of a form-fit connection.

The invention also relates to a bottle teat which comprises, in an end portion lying opposite a suction opening, a cylindrical portion with a slightly larger inner diameter than the outer diameter of the container adjacent to the connection opening, which cylindrical portion comprises a sealing lip projecting inwards at the end. By means of such a projecting sealing lip, a seal between the bottle body and the teat is reliably obtained, wherein the sealing lip is constituted such that the sealing effect is increased in the presence of higher pressure differences between the bottle interior and the surroundings.

Furthermore, it is advantageous for an interaction of the bottle teat with a sleeve cap according to the invention if the cylindrical portion comprises a circumferential, preferably annular web projecting upwards in the direction of the suction opening. Such an annular web accordingly interacts in a form-fitting manner with a projecting circumferential web or web portions of the sleeve cap, so that the bottle teat is reliably held between the bottle body and the sleeve cap even with comparatively low axial (pressing) forces between the sleeve cap and the bottle body.

If the bottle teat, in the flange-shaped end portion lying opposite the suction opening at the upper side facing the suction opening, comprises a groove-shaped recess preferably running corresponding to an edge of the upper connection opening of the container, the groove-shaped region can easily yield in a resilient manner during the snapping-on of the connection part on the container and thereafter seeks to return to its unstressed initial position. With the aid of this resilient restoring force, therefore, the connection part together with the engaging element is advantageously pressed upwards into the preferably undercut contact faces of the web, so that the connection part and the container are connected to one another essentially without any play. The groove-shaped region can be produced either by tapering of the material or deformation of the material with an essentially constant wall thickness.

Furthermore, the invention also relates to an insertion part for a container according to the invention, wherein the insertion part in an outer end portion comprises a cylindrical portion with a slightly greater inner diameter than the outer diameter of the container adjacent to the bottom connection opening, wherein the cylindrical portion comprises an inwardly projecting sealing lip at the end. Just as in connection with the bottle teat described above, a seal is thus produced between the insertion part of the bottom valve and the bottle body, which seal exerts an increased sealing effect accordingly as the pressure difference between the interior of the bottle body and the surroundings increases. Such sealing lips are sufficiently well known in principle from sealing joints, such as are used for example in washing machine hatches.

If the insertion part comprises, in a bottom flange-shaped end portion at the underside facing a connection part when in use, a groove-shaped recess, preferably running corresponding to an edge of a lower connection opening of the container, the groove-shaped region can easily yield in a resilient manner during the snapping-on of the connection part on the container and then seeks to return to its unstressed initial position. With the aid of this resilient restoring force, therefore, the container together with the preferably undercut contact faces of the webs are pressed upwards, so that the connection part and the container are connected to one another essentially without any play. Here too, the groove-shaped region can be produced either by tapering of the material or deformation of the material with essentially constant wall thickness.

BRIEF DESCRIPTION OF THE DRAWINGS

The invention is explained below in greater detail on the basis of preferred examples of embodiment, to which however it is not intended to be limited. In the drawings, in detail.

DETAILED DESCRIPTION

Figure 1:
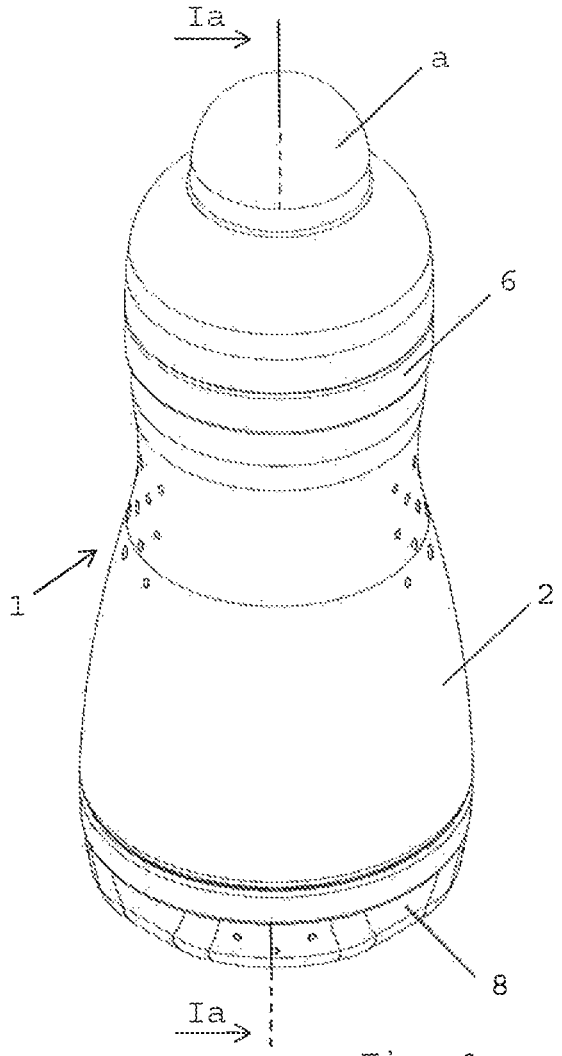
FIG. 1 shows a perspective view of a container according to the invention in the form of a baby bottle.
Figure 1A:
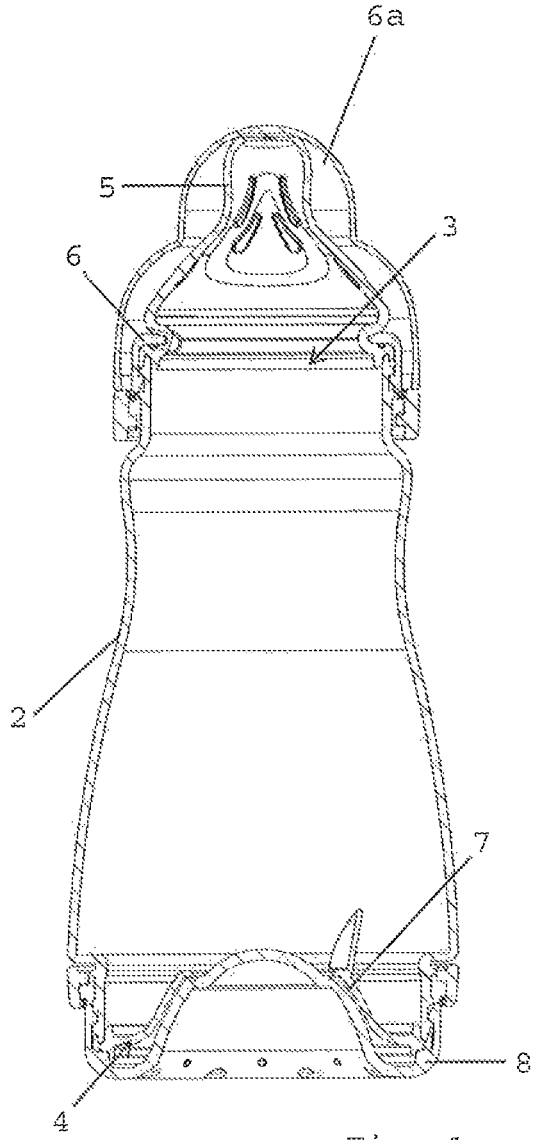
FIG. 1*a* shows a cross-sectional view along line Ia-Ia in FIG. 1.

FIG. 1 shows container 1 according to the invention with a jacket-shaped bottle body 2, which—as can be seen in FIG. 1*a*—comprises an upper container opening 3 and a lower container opening 4. A bottle teat 5 is fastened on upper container opening 3 with the aid of a sleeve cap 6 constituted as a connection part. A valve insertion part 7 is provided at lower container opening 4, which valve insertion part is fastened with the aid of a lower bottom cap 8. A cover cap 6*a* can also be seen, which is snapped onto sleeve cap 6 especially when the baby bottle is not in use and closes the drinking opening(s) of bottle teat 5 in a sealing manner in the snapped-on position.

Figure 2:
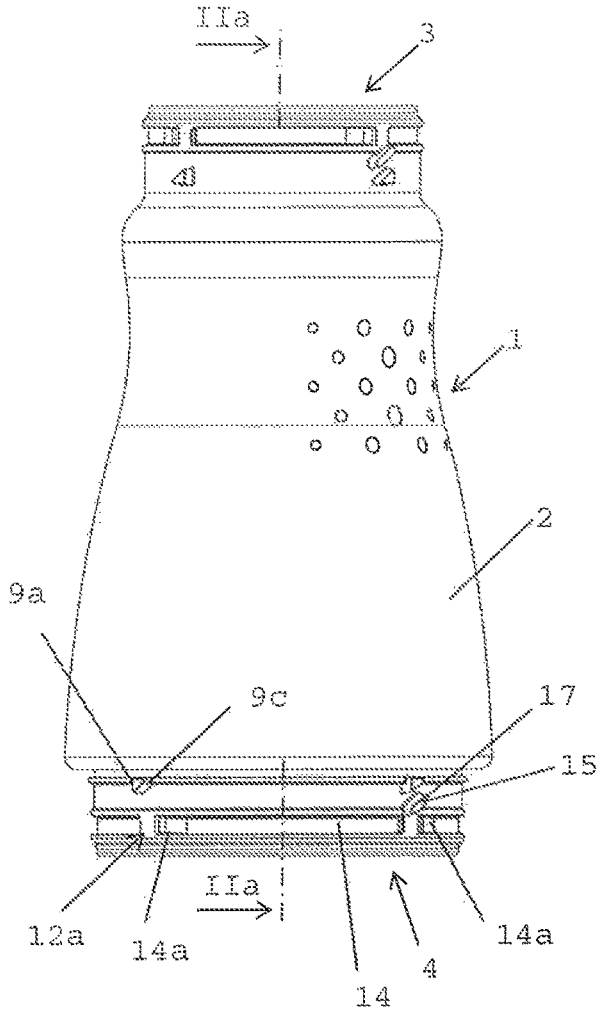
FIG. 2 shows a view of the bottle jacket of the baby bottle according to FIG. 1 provided as a container.
Figure 2A:
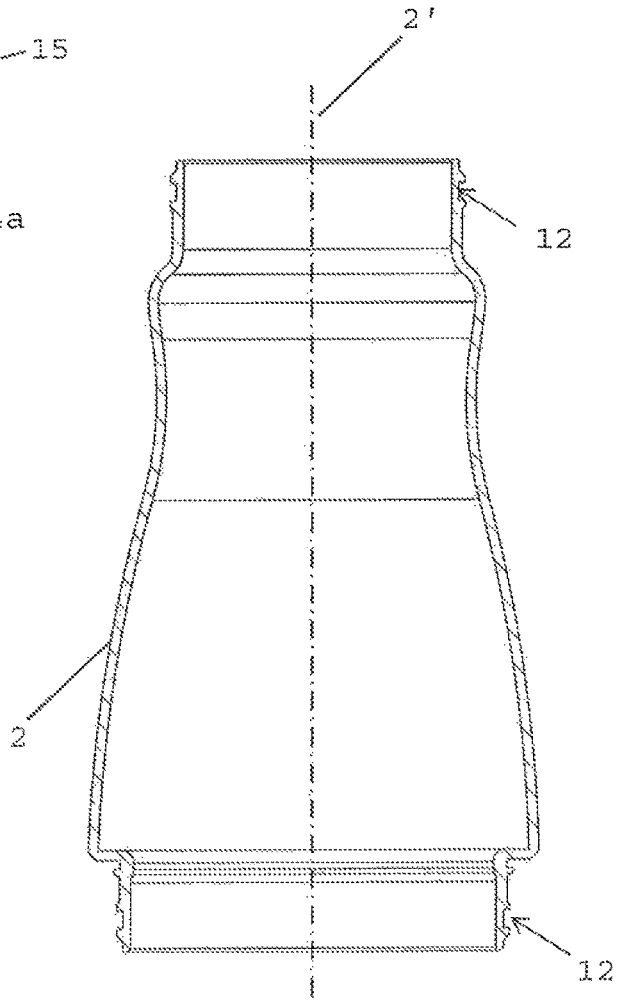
FIG. 2*a* shows a cross-sectional view along line IIa-IIa in FIG. 2.
Figure 3:
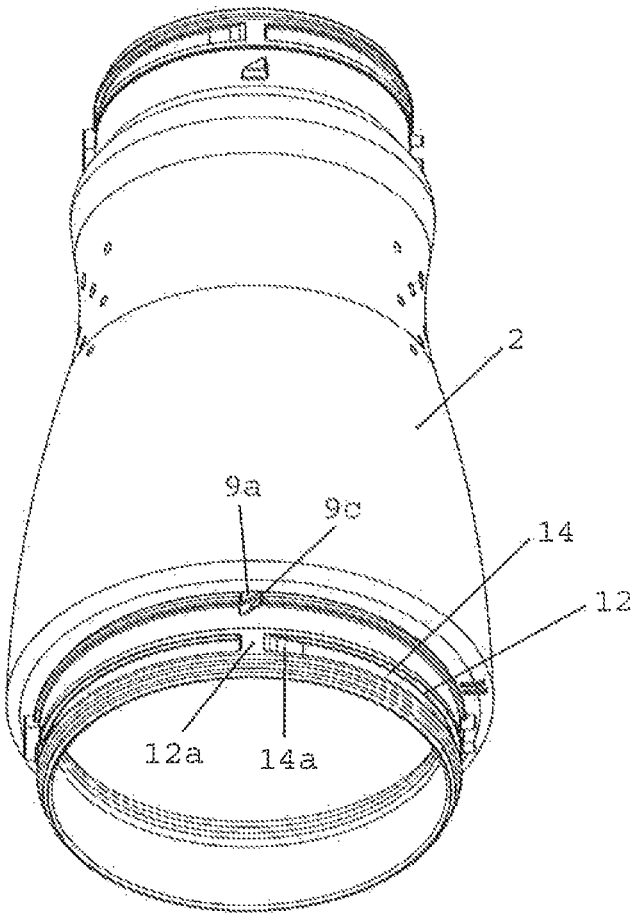
FIG. 3 shows a perspective view of the bottle jacket from below according to FIG. 2*a*.
Figure 6:
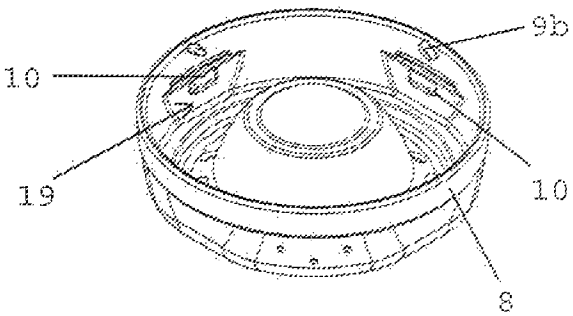
FIG. 6 shows a perspective view of a lower connection part according to FIG. 4 from above.
Figure 5:
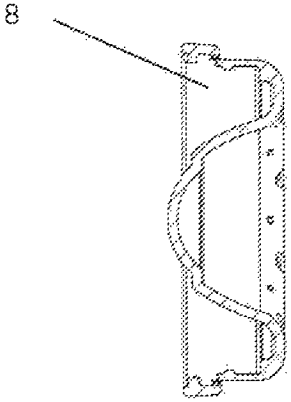
FIG. 5 shows a cross-sectional view along line V-V in FIG. 4.
Figure 7:
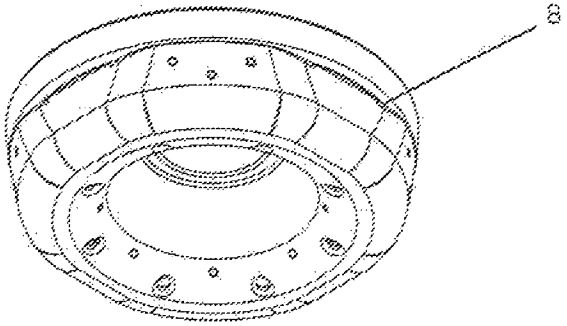
FIG. 7 shows a perspective view of the lower connection part according to FIG. 4 from below.
Figure 4:
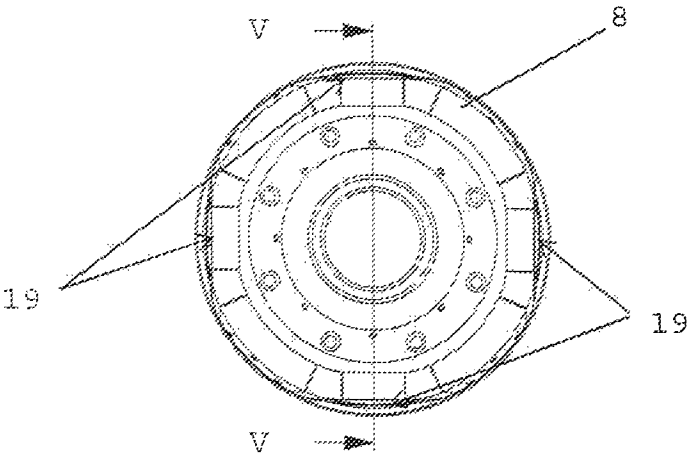
FIG. 4 shows a plan view of a lower connection part.
Figures 8, 8A, 9, 10:
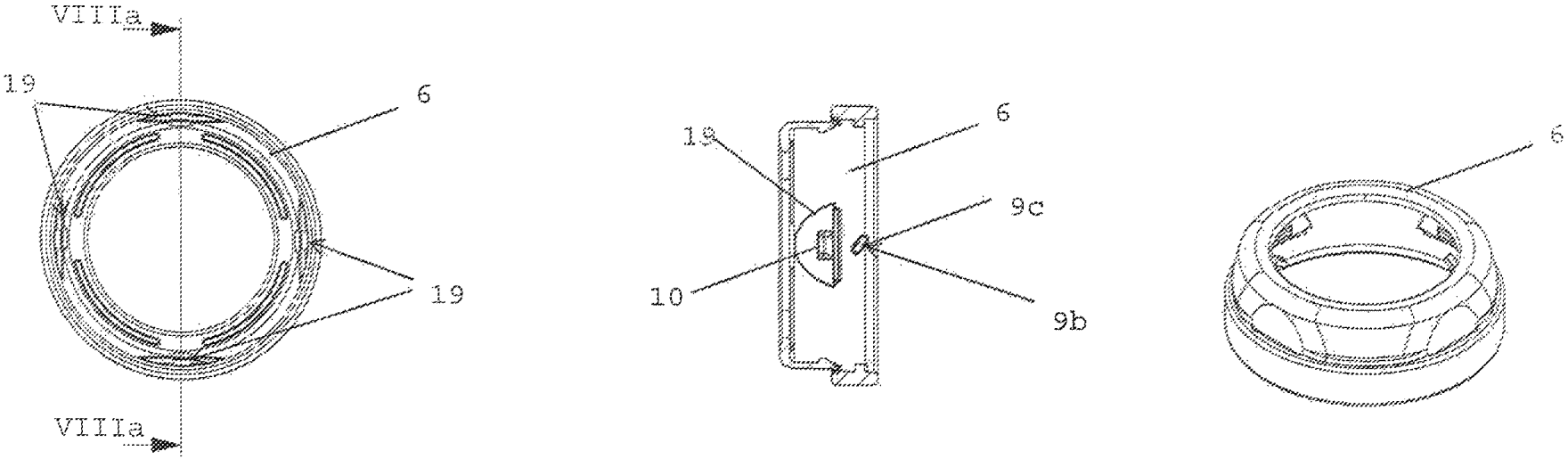
FIG. 8 shows a view of an upper connection part from below.
FIG. 8*a* shows a cross-sectional view along line VIIIa-VIIIa in FIG. 8.
FIG. 9 shows a perspective view of the upper connection part according to FIG. 8 from above.
FIG. 10 shows a perspective view of the upper connection part according to FIG. 8 from below.

Bottle body 2 is shown in detail in FIGS. 2, 2*a* and 3, wherein it can in particular be seen that bottle body 2, in a region adjacent to upper connection opening 3 or lower connection opening 4, comprises in each case a plurality of grooves 12, four in the example of embodiment shown, which run essentially along a longitudinal extension plane perpendicular to a longitudinal axis 2' of bottle body 2. These grooves 12 are intended to receive engaging elements 10, which are provided at the inner face of a skirt of sleeve cap 6 and bottom cap 8 (see in particular FIGS. 6*a* and 10).

These spring-mounted engaging elements 10 are received—as can be seen in particular in FIG. 1*a*—in the grooves 12 in the connected position, so that sleeve cap 6 and bottom cap 8 are each in a snap-in connection with bottle body 2. The contact faces of engaging elements 10 or of grooves 12 can comprise undercuts, preferably at an angle of approximately 5°-15°, in order to reliably prevent an undesired release of the snap-in connection even in the presence of fairly great tractive forces acting in the longitudinal direction of container 1.

In order to be able to release engaging elements 10 again from the connection shown in FIG. 1*a*, bottle body 2 and connection parts 6, 8 comprise run-on elements 9*a*, 9*b*.

When connection part 6, 8 is rotated against the snapped-in position, in which engaging elements 10 are received in a receiving portion 14 of respective groove 12, engaging elements 10 are moved over an inclined run-on ramp 14*a* out of receiving portions 14 of grooves 12 and are then displaced towards one another in longitudinal direction 2' of bottle body 2 with the aid of inclined run-on surfaces 9*c* of run-elements 9*a*, 9*b*, the run-on surfaces 9*c* running onto one another, so that engaging elements 10 are then arranged, viewed in longitudinal direction 2', above or below adjacent grooves 12. Engaging elements 10 are located here during the displacement in longitudinal direction 2' in an intermediate region 12*a* between two adjacent grooves 12, in which the surface of bottle body 2 is essentially flush with the adjacent surface of remaining bottle body 2.

It can also be seen in particular in FIG. 2 that container 1 comprises a guide element 15 which, viewed in the longitudinal direction, is arranged in region 12*a* between two grooves 12, so that a plugging-together in the direction of the longitudinal axis 2' of bottle body 2, in which engaging elements 10 do not snap into grooves 12, is made impossible. If engaging elements 10 are in fact undesirably arranged precisely in alignment with regions 12*a* between two adjacent grooves 12, a run-on element 9*b* runs in each case on an inclined guide flank 17 of respective guide element 15, so that a rotation of container 1 or bottle body 2 and connection element 6, 8 towards one another is achieved and engaging elements 10 snap into grooves 12.

As can also be seen in FIGS. 4 to 10, engaging elements 10 are preferably arranged in wall portions 19 which, in contrast with the essentially rotation-symmetrical circular course, project inwards from a jacket portion of connection part 6, 8, and their imaginary connecting lines essentially form a rectangle. As a result of this inwardly projecting shape diverging from the circular shape, projecting wall portions 19 together with engaging elements 10 are elastically deformed during the snapping-on. In the snapped-on position, wall portions 19 thus remain elastically deformed and, only when released from the snapped-on connection, return again to their unstressed position diverging from the circular shape.

Figure 11:
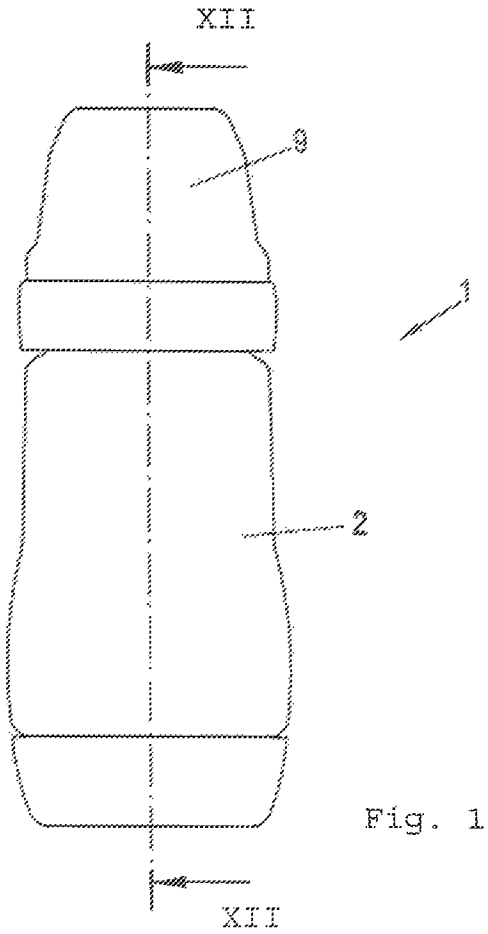
FIG. 11 shows a view of an alternative example of embodiment of a container according to the invention in the form of a baby bottle.
Figure 12:
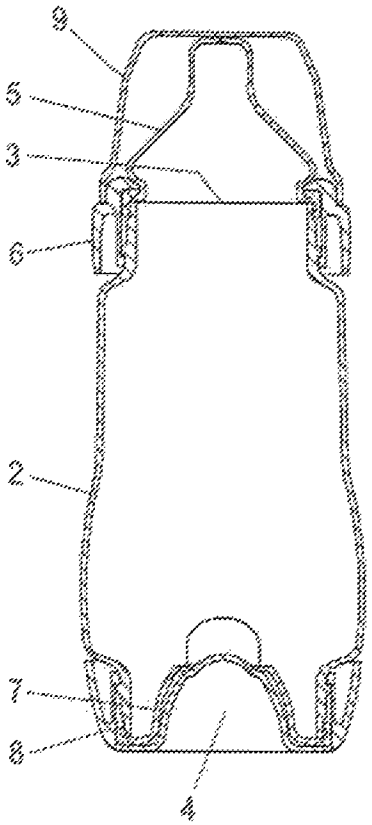
FIG. 12 shows a cross-sectional view along line XII-XII in FIG. 11.

FIG. 11 shows an alternative example of embodiment of a container 1 according to the invention in the form of a baby bottle, wherein this baby bottle 1 also comprises a bottle body 2, which—as can be seen in particular in FIG. 12—comprises an upper container opening 3 and a lower container opening 4. Once again, a bottle teat 5 is fastened on upper container opening 3 with the aid of a sleeve cap 6. A valve insertion part 7 is fastened to lower container opening 4 with the aid of a lower bottom cap 8.

Figure 13:
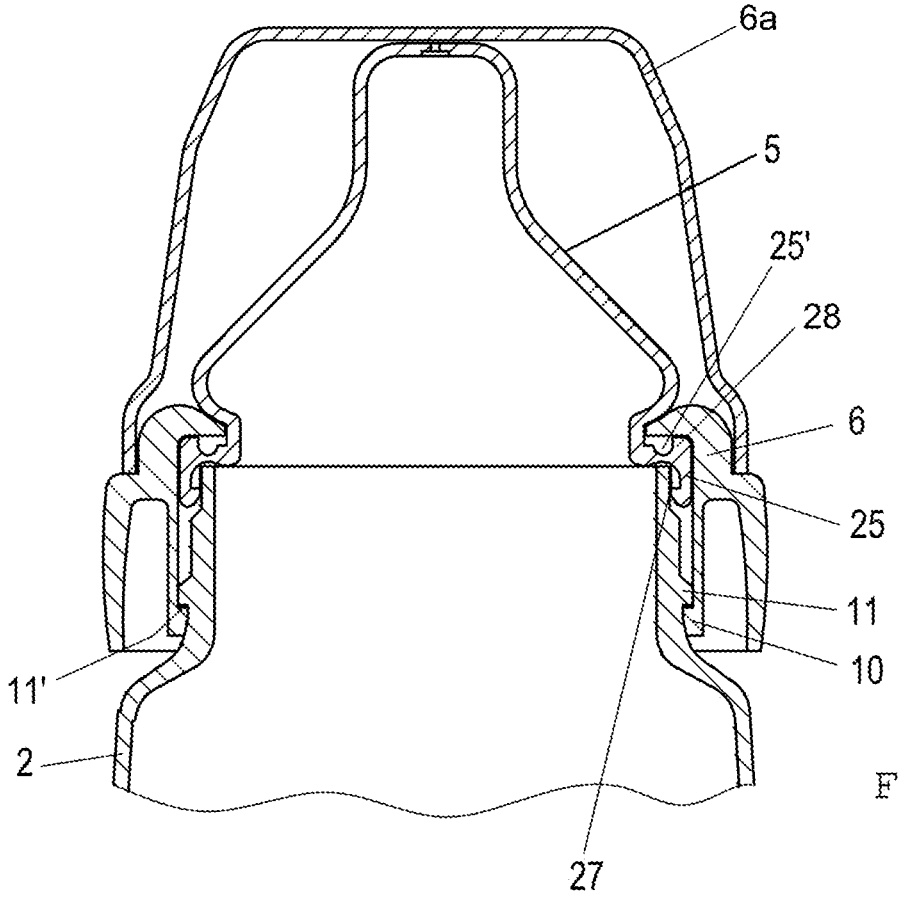
FIG. 13 shows an enlarged cross-sectional view according to FIG. 12 in the region of an upper bottle container opening.
Figure 14:
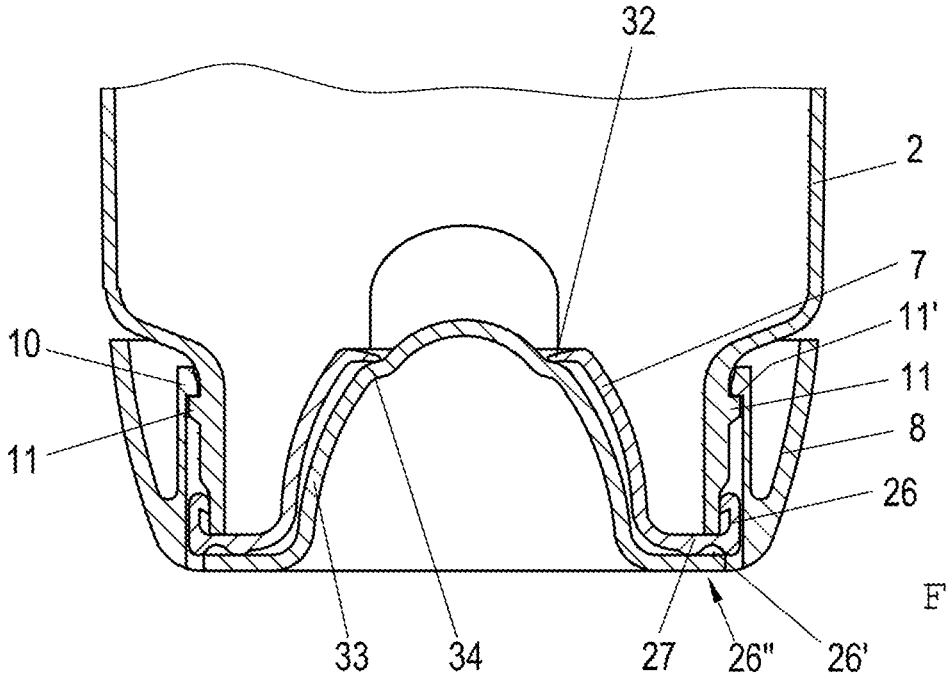
FIG. 14 shows an enlarged cross-sectional view according to FIG. 12 in the region of a lower bottle opening.

In FIGS. 13 and 14, in an enlarged representation, sleeve cap 6 and respectively bottom cap 8 provided as connection parts of container 1, in particular, are shown in detail in the connected representation with bottle body 2. It can be seen here that sleeve cap 6 and bottom cap 8, each comprise engaging elements 10, which are spring-mounted and, in the fastened positions shown in FIGS. 13 and 14, each engage behind a web 11 in the region of upper and lower bottle opening 3 and 4, so that teat 5 and valve insertion part 7 are reliably connected to bottle body 2 by means of sleeve cap 6 and respectively bottom cap 8. Contact faces 11' of engaging elements 10 and/or of webs 11 between engaging elements 10 and webs 11 preferably comprise undercuts in the shown receiving portion 14 of groove 12. Such undercuts can in particular form an angle of approximately 5-15° with respect to a right angle to the surfaces from which the engaging elements or webs project, so that an undesired release of the snap connection is reliably prevented even in the presence of fairly large tractive forces acting in the longitudinal axis of the container.

Figure 15:
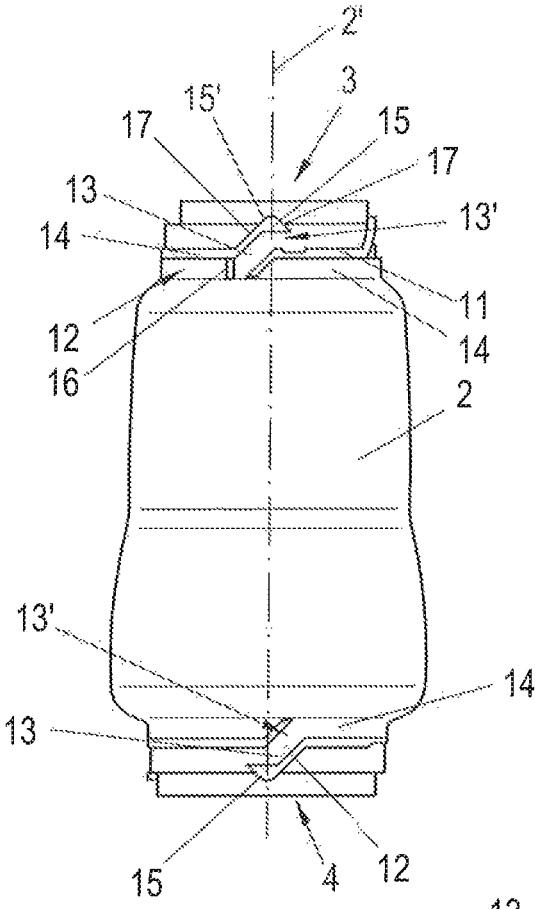
FIG. 15 shows a view of a bottle body with an upper and lower container opening.
Figure 16:
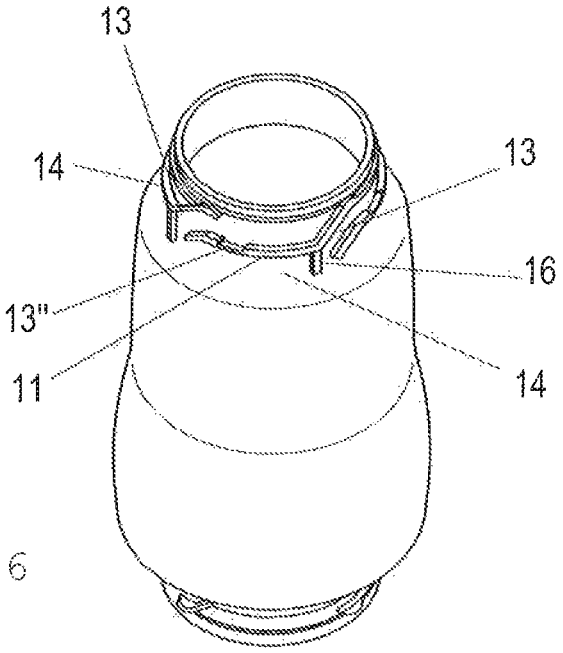
FIG. 16 shows a perspective view of the bottle body according to FIG. 15.

As can be seen in particular from FIGS. 15 and 16, bottle body 2, in a region adjacent to upper connection opening 3 and also in a region adjacent to lower connection opening 4, in each case comprises a plurality of grooves 12, four in the example of embodiment shown, in the manner of a bayonet connection. Grooves 12 each comprise an end portion 13 having a ramp shape, that is, running obliquely to an orthogonal plane to a longitudinal axis 2' of container 1 as well as a receiving portion 14 running essentially along an orthogonal plane to longitudinal axis 2'.

End portion 13 comprises an opening 13', wherein an introduction into this opening 13' is however only possible in a rotational direction, i.e. orthogonal to longitudinal axis 2' of bottle body 2. In order reliably to prevent an introduction into end portion 13 in the direction of longitudinal axis 2', a guide element 15 is provided in each case in the direction of longitudinal axis 2' above and below in a region adjacent to opening 13'.

These guide elements 15 therefore prevent engaging elements 10 from being introduced into end portions 13 when a connection part 6, 8 is united in the direction of longitudinal axis 2' of container 1. It is thus ensured that, when connection part 6, 8 is brought together with container 1 in the direction of longitudinal axis 2', engaging elements 10 are not introduced into end portion 13 of grooves 12. On the contrary, in the case where the rotational alignment between connection part 6, 8 and container 2 is such that an engaging element 10 and a guide element 15 meet one another during the bringing-together in longitudinal direction 2', the rotational alignment of connection part 6, 8 changes with respect to container 2. For this purpose, guide elements 15 each comprise guide flanks 17 at the side of a rounded tip 15', which guide flanks cooperate with respective engaging element 10, more precisely corresponding contact flanks 18 (see also FIGS. 19, 20, 21 and 23). Engaging elements 10 thus slide along obliquely arranged guide flanks 17, so that connection part 6, 8 is rotated with respect to the container or bottle body 2, until engaging elements 10 each strike against web 11, above or below which they then snap in in respective receiving portion 14 of respective groove 12. With a continued application of pressure in the direction of longitudinal axis 2', engaging elements 10 pivot on account of their spring-loaded bearing and snap in behind respective web 11. In the transition region between the end portion and receiving portion of groove 12, a securing web 16 running transversely to the longitudinal extension of groove 12 is provided in each case, which securing web can only be overcome with the application of an increased rotational force. As a result of the overcoming of securing webs 16, it can thus be recognised by the user that the connection has been released.

As can further be seen in FIG. 16, web 11 comprises a recess 13" in a portion adjacent to opening 13' of an adjacent groove. This recess 13" forms a kind of receiving pocket in the region of opening 13', so that, insofar as an engaging element 10 should come into contact in this region, a rotation into opening 13' is prevented. With further application of a force in longitudinal direction 2' of container 2, snapping-in by means of the snap connection thus takes place in this case.

With regard to a spring-mounted bearing, engaging elements 10—as can be seen in FIGS. 19 to 23—can be arranged projecting inwards in particular on a circumferential wall 19.

As can also be seen in FIGS. 19 to 23, inner circumferential wall 19 is constituted integral with the remaining connection part, i.e. sleeve cap 6 and bottom cap 8, wherein however inner wall 19 has a much smaller wall thickness compared to an outer wall 20, which produces the stability of the respective connection part. When the connection parts are produced from a thermoplastic plastic, e.g. polypropylene (PP), a wall thickness between 0.5 mm and 3.5 mm in particular has proved to be advantageous.

Due to the relatively small wall thickness, the entire circumferential wall is thus easily elastically deformable. In order to ensure the easy snapping-over on associated web 11, the circumferential wall does not comprise a circular course in its unstressed position, but rather a course diverging from a circular shape, which course essentially corresponds to a square shaped with rounded corners in the example of embodiment shown. When engaging elements 10 pass over respective web 11, wall 19 carrying engaging elements 10 can thus essentially assume a circular shape, then to return again into the square shape diverging from a circular shape, shown in particular in FIGS. 19 and 21. Reliable snapping-in between respective web 11 and associated engaging element 10 is thus ensured.

Figure 24:
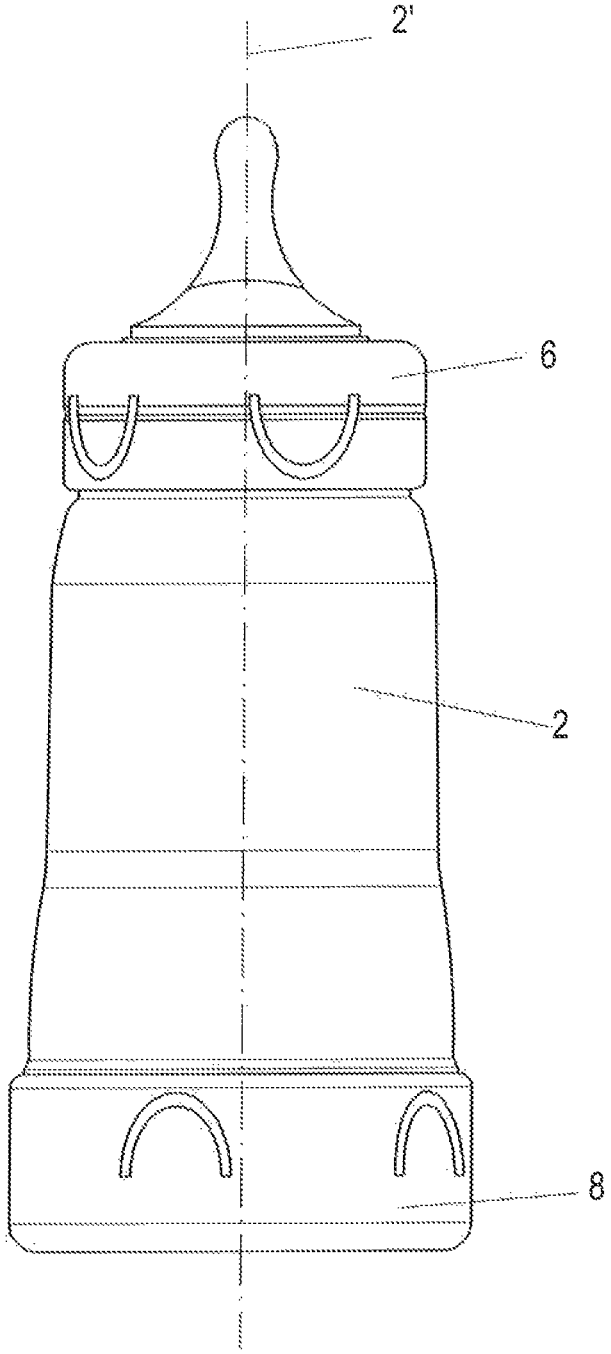
FIG. 24 shows a view of an alternative example of embodiment of a container according to the invention.

An alternative example of embodiment to this kind of spring-loaded mounting of engaging elements 10 is shown in FIG. 24. Here too, a container 1 with a bottle body 2 is also shown, on which a sleeve cap 6 and a bottom cap 8 are provided as connection parts.

Figure 25:
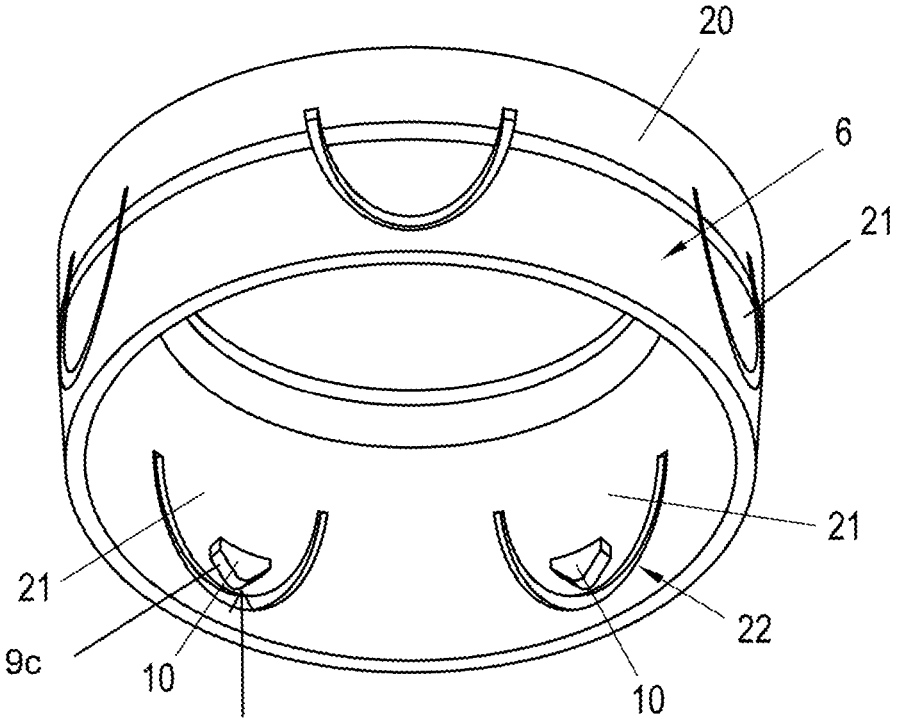
FIG. 25 shows a perspective view of a sleeve cap of the example of embodiment according to FIG. 14.
Figure 26:
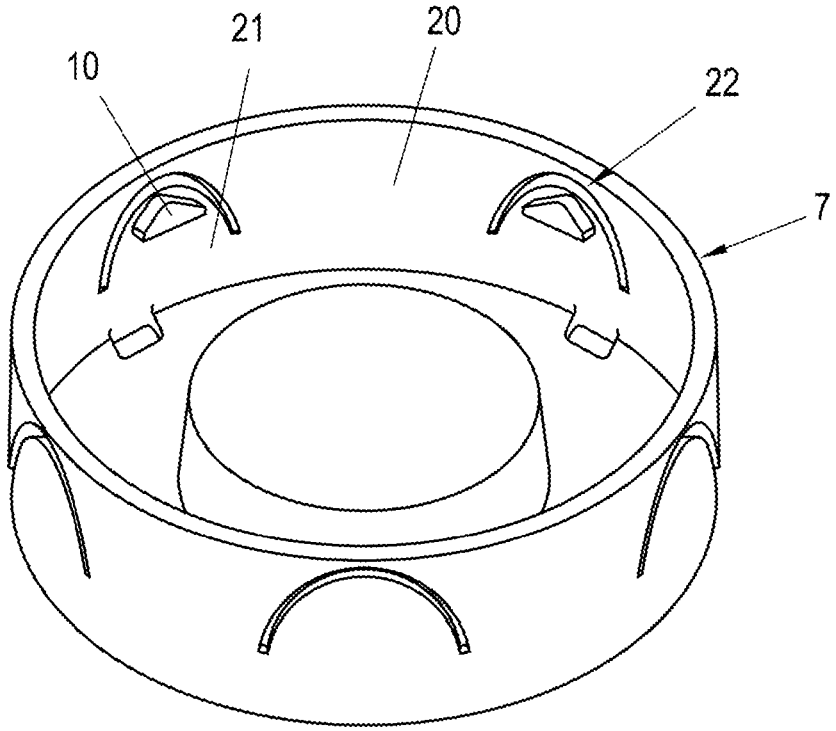
FIG. 26 shows a perspective view of a bottom cap of the example of embodiment according to FIG. 14.

As can be seen in particular in FIGS. 25 and 26, it is also possible—as an alternative to a comparatively thin-walled elastic wall 19—for engaging elements 10 to be constituted on an outer wall 20, wherein in this example of embodiment engaging elements 10 are each arranged in the end region of detent tongues 21.

Detent tongues 21 are again obtained by material recesses or cutouts 22 in outer wall 20. As can be seen in FIG. 24, a container 1 can also thus be connected to two connection parts 6, 8, which are connected either by a snap connection produced in longitudinal direction 2' or, however, by an insertion/rotation connection with flange body 2 shown in particular in FIGS. 15 and 16.

Figure 17:
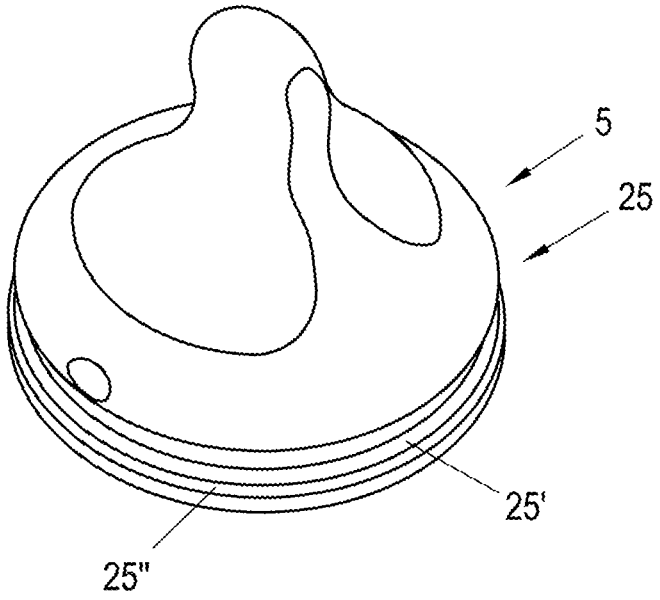
FIG. 17 shows a perspective view of a bottle teat.
Figure 18:
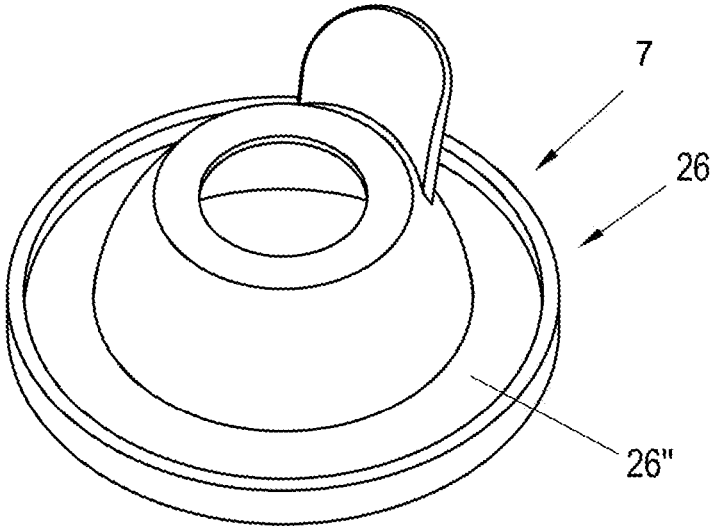
FIG. 18 shows a perspective view of an insertion part of a bottom valve.

FIGS. 17 and 18 show in detail a bottle teat 5 and insertion part 7 [[8]], which are constituted specially for use with sleeve cap 6 and bottom cap 8.

Bottle teat 5 comprises here in a cylindrical end portion 25, which in the assembled position comprises a slightly larger inner diameter compared to an outer diameter of bottle body 2 in the region of upper container opening 3, as can be seen in particular in FIG. 13.

It can further be seen in FIG. 17 that bottle teat 25 comprises a circumferential groove 25' at the upper side of a fastening flange 25". As can be seen in particular in FIG. 13, groove 25' is arranged essentially congruent with an edge of upper container opening 3. When connection part 6 and container 2 are plugged together, teat 5 thus yields in a resilient manner in the region of groove 25', so that, as a result of the pretensioning thus produced in the connected position shown in FIG. 13, contact faces 11' of webs 11 and engaging elements 10 are pressed together by fastening flange 25" and respectively groove 25', so that in the connected state the contact faces reliably lie against one another.

An analogous effect is achieved in the region of lower container opening 4 with the aid of insertion part 7. For this purpose, insertion part 7 in the region of a fastening flange 26" at its underside comprises a groove 26' (see FIG. 14), which in the connected state is arranged essentially congruent with an edge of lower container opening 4. When connection part 8 and container 2 are plugged together—with the interposition of insertion part 7—insertion part 7 thus yields in a resilient manner in the region of groove 26', so that, as a result of the pretensioning thus generated in the connected position shown in FIG. 14, contact faces 11' of webs 11 and engaging elements 10 are pressed against one another by fastening flange 26" and respectively groove 26'.

It can further be seen in FIG. 13 that cylindrical portion 25 at its lower end comprises a circumferential sealing lip 27 tapering towards a free end and directed inwards, which sealing lip lies under pretensioning in a sealing manner against the outer surface of bottle body 2 in the upper end portion. If the pressure difference between the interior of container 1 and the surrounding environment should increase, sealing lip 27 is thus pressed with increased pressing force on the outer surface of bottle body 2, so that the sealing effect is increased depending on the pressure difference between the interior in container 1 and the ambient pressure.

Figure 21:
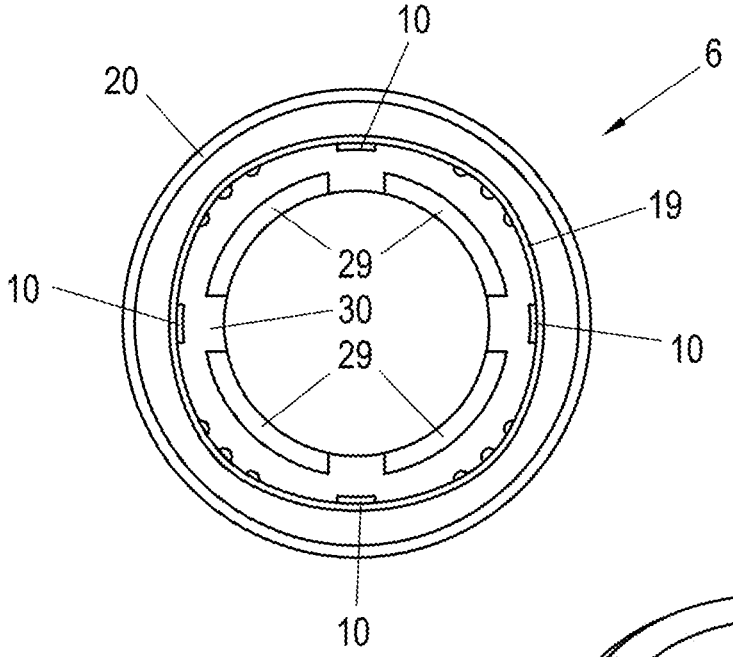
FIG. 21 shows a plan view from below of an upper sleeve cap provided as a connection part.
Figure 22:
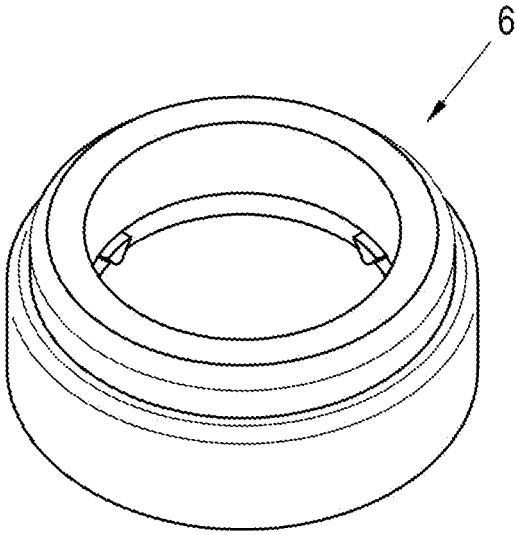
FIG. 22 shows a perspective view of the sleeve cap according to FIG. 21 from above.
Figure 23:
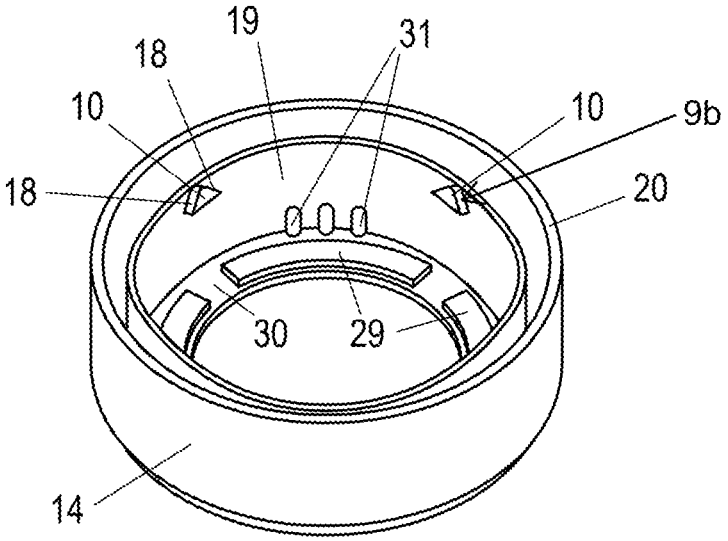
FIG. 23 shows a perspective view of the underside of the sleeve cap according to FIG. 21.

It can further be seen that cylindrical end portion 25 comprises a circumferential web 28 projecting upwards. This circumferential web 28 is essentially provided to cooperate with a web or web portions 29 at the underside of a cap portion 30 of sleeve cap 6. As can be seen in FIGS. 21 and 23, downwardly projecting web portions 29 of cap portion 30 of sleeve cap 6 are—in particular for deformation purposes—interrupted, so that in the example of embodiment shown four essentially circle segment-shaped web portions 29 result, which engage behind projecting web 28 on teat 5, so that undesired pulling out of teat 5 in the connected state between container 2 and sleeve cap 6 is not possible even in the presence of a relatively low contact pressure between sleeve cap 6 and container 2 in the direction of longitudinal axis 2'.

Figure 19:
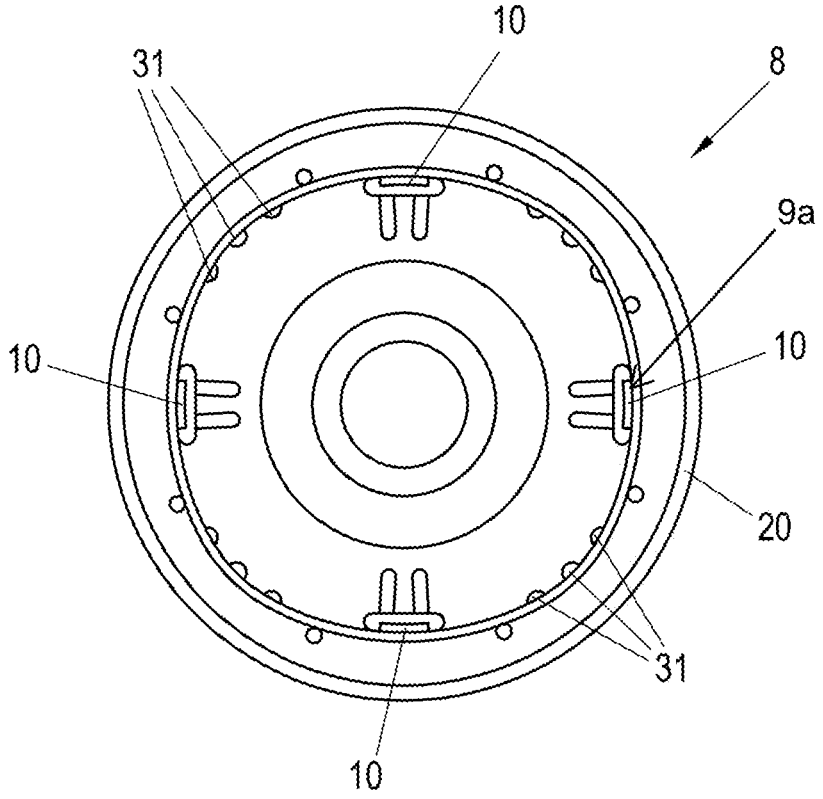
FIG. 19 shows a plan view of a lower bottom cap provided as a connection part.
Figure 20:
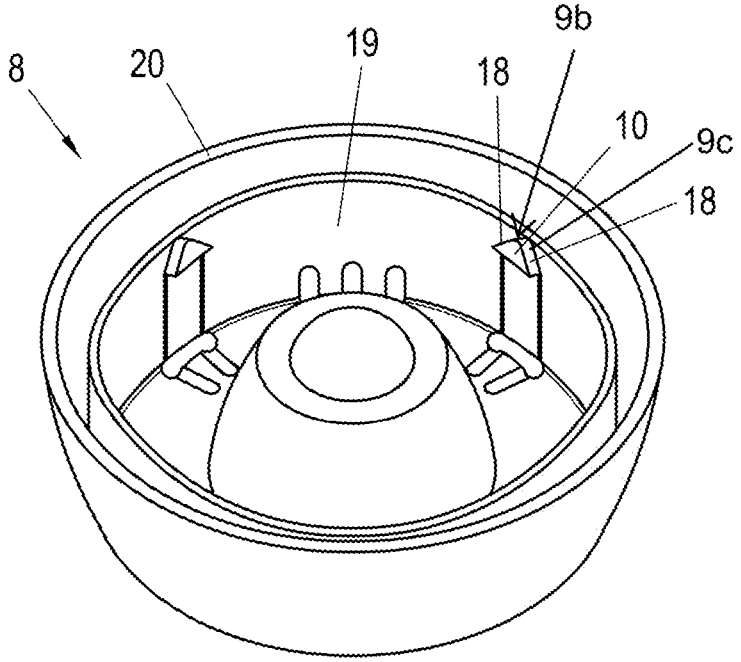
FIG. 20 shows a perspective view of the bottom cap according to FIG. 19.

In FIGS. 21 and 23 projections 31 are distributed around the circumference adjacent the web portions 29 in the transition region between the underside of cap portion 30 and inner wall 19, wherein in the example of embodiment shown three nub-like projections 31 are provided four times. These projections 31 are provided in order to centre bottle teat 5, i.e. despite the course of wall 19 diverging from a circular shape, in order reliably to position teat 5 centrally. Corresponding projections 31 are also provided, as can be seen in FIGS. 19 and 20, for the centering or exact positioning of insertion part 7 in bottom cap 8.

Insertion part 7 represented in FIG. 18 for forming an air intake valve together with bottom cap 8 also comprises—as can be seen in particular in FIG. 14—a cylindrical end portion 26, which comprises a larger inner diameter than bottle body 2 in the region of lower container opening 4 at the outer surface. End portion 26 comprises—corresponding to bottle teat 5—a circumferential sealing lip 27 projecting inwards and tapering towards its free end, which sealing lip lies under pretensioning in a sealing manner against the outer surface of bottle body 2. The sealing principle already described in connection with the bottle teat 5 thus results.

It can further be seen in FIG. 14 that insertion part 7 comprises a sealing lip 32, which enables an air intake in the presence of an underpressure in the interior of container 2, but which prevents an exit of liquid. In the example of embodiment shown, sealing lip 32 lies on an annulus-shaped upper platform 34 of an inwardly projecting dome-shaped recess 33 of bottom cap 8. As an alternative to the shown sealing seating of this circumferential sealing lip 32 on the platform 34, however, a seating of a sealing lip on the lower bottom portion of bottom cap 8 outside dome-shaped recess 33 is also possible, as well as a sealing seating at the outer side of the entire dome-shaped recess 33 of bottom cap 8.

Figure 27:
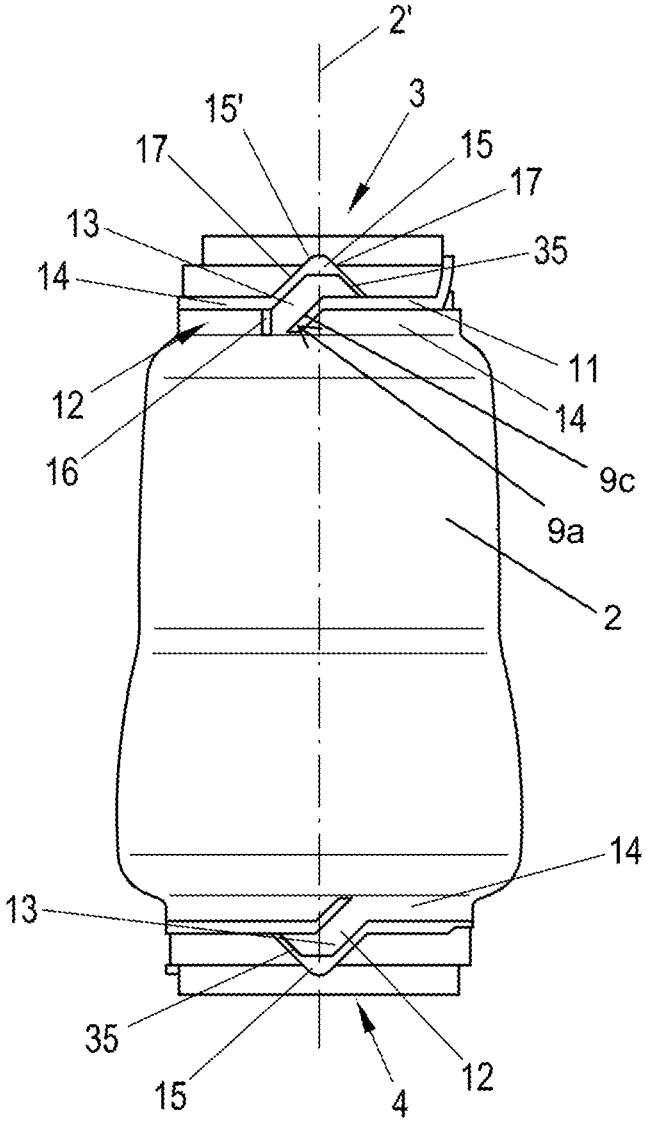
FIG. 27 shows a view of a bottle body with upper and lower openings of an alternative example of embodiment.

FIG. 27 shows a bottle body 2 of an alternative example of embodiment, which largely corresponds to the example of embodiment according to FIGS. 11 to 26, but in this example of embodiment the opening 13' of end portion 13 of respective groove 12, shown in FIG. 15, is provided with a stop 35. In this example of embodiment, therefore, a connection of connection parts 6, 8 to container 1 by means of an insertion/rotation connection is thus not possible with the aid of stop 35—in contrast with the previously described examples of embodiment, but rather a connection between connection parts 6, 8 and container 1 is only possible by means of a snap connection. A release of the connection is of course once again possible—as described above—by means of a rotational movement, wherein respective engaging element 10 acts as run-on element 9*b* having a run-on surface 9*c* running on run-on surface 9*c* of run-element 9*a* for removing engaging element 10 from respective groove 12 via opening 13'. Since stop 35 has to be overcome, it is advantageous if stop 35 comprises a run-on ramp directed towards groove 12, in order to facilitate the removal of respective engaging element 10 from end portion 13. The other flank of stop 35, on the other hand, is advantageously arranged essentially at a 90° angle to the bottom of the groove, in order to prevent an undesired connection by a rotational movement.

The invention has been described below in connection with a bottle container, in particular a baby bottle. Container 1 according to the invention or the fastening of a connection part 6, 8, which reliably takes place by means of a snap connection, can of course also be used in connection with other containers such as for example breast pumps, storage and transport containers in general and other food packages and suchlike, as well as containers in general.

The invention claimed is:

1. A container comprising:

a container body extending along a longitudinal axis;

at least one connection part;

at least one connection opening; and interacting connection elements configured to connect the container body and the at least one connection part, a first of the interacting connection elements being provided on the container body and a second of the interacting connection elements being provided on one of the at least one connection part;

the first of the interacting connection elements comprising grooves and the second of the interacting connecting elements comprising spring-mounted engaging elements, wherein each of the grooves comprises a receiving portion extending perpendicular to the longitudinal axis of the container body; and the at least one connection part comprising run-on elements with run-on surfaces running obliquely in relation to the longitudinal axis of the container body;

wherein the at least one connection part and the container body are configured to be brought into a connected state by means of a snap-in connection by bringing together the at least one connection part and the container body in a direction along the longitudinal axis of the container body in the connected state, the spring-mounted engaging elements being engaged in receiving portions of respective grooves after being pivoted;

wherein by means of a rotational movement between the container body and the at least one connection part the engaging elements are configured to be moved out of the receiving portions of respective grooves and to interact with the run-on surfaces such that in a rotated position, the snap-in connection between the container body and the connection part is released.

2. The container according to claim 1, further comprising:

a guide element preventing the connection part and the container body from being brought together in a direction of the longitudinal axis;

the guide element being provided in a portion between adjacent ones of the grooves or in an end portion of the grooves, such that a rotation of the at least one connection part and the container body with respect to one another is configured to be brought about when the connection part and the container body are brought together in the direction of the longitudinal axis of the container body.

3. The container according to claim 2, wherein:

the run-on element of the connection part interacts with the guide element of the container body when the connection part and the container body are brought together in the direction of the longitudinal axis with lined-up alignment with respect to one another, in such a way that a rotation of the connection part and the container body is brought about.

4. The container according to claim 2, wherein:

the guide element comprises at least one guide flank running obliquely with respect to the longitudinal axis of the container body.

5. The container according to claim 1, wherein:

contact faces of the engaging elements and/or of the grooves comprise an undercut at least in a plurality of sections.

6. The container according to claim 1, wherein:

each of the grooves comprises a respective ramp-shaped end portion connecting the receiving portion of the respective groove with a portion between two of the grooves that is flush with the remaining outer surface of the container in a-region of the at least one connection opening.

7. The con tamer according to claim 1, wherein;

the grooves are arranged at the outer side of a cylindrical jacket surface of the container body and the engaging elements are arranged at an inner side of wall portions of the connection part, wherein connecting lines between the engaging elements in an unstressed position have a course diverging from a circular shape;

the wall portions are elastically deformable such that each of the engaging elements are configured to be snapped over a web.

8. The container according to claim 7, wherein:

the at least one connection part, apart from wall portions carrying the engagement elements, comprises a rotation-symmetrical circumferential wall.

9. The container according to claim 1, wherein:

the grooves of the interacting connection elements comprise a bayonet connection; and the engaging elements of the interacting connection elements are configured to be snapped in over a web adjacent to respective ones of the grooves along the longitudinal axis of the container body into the connected position and are configured to be released from the respective grooves through an opening.

10. The container according to claim 9, wherein:

the interacting connection elements can be connected to one another, as an alternative to a snap connection, by means of an insertion/rotation movement; and the engaging element can be introduced in each case via the opening into the receiving portion of the respective groove.

11. The container according to claim 9, wherein:

the opening comprises in each case a stop preventing the introduction of one of the engaging elements.

12. The container according to claim 9, wherein:

the guide element comprises a tip viewed in the direction of the longitudinal axis of the container body, which tip is rounded off and which is adjoined by guide flanks on both sides;

one guide flank in each case connects to the web adjacent to the groove and the other guide flank ends in each case adjacent to an opening.

13. The container according to claim 11, wherein:

the engaging elements have a shape of a triangle with a rounded-off tip;

wherein the tip strikes the tip of the guide element during the approach of the connection part towards the container with a corresponding rotational alignment.

14. The container according to claim 9, wherein:

proceeding from the opening, each groove comprises an end portion which runs in such a way that an engaging element received in a groove is guided obliquely to an orthogonal plane to the longitudinal axis of the container body, and which connects to the receiving portion, which is bordered on one side by the web running along an orthogonal plane to the longitudinal axis of the container body.

15. The container according to 9, wherein:

the web bordering the groove comprises a recess in a portion bordering the opening of an adjacent groove, at the side from which the connection part is advanced towards the container body for the connection.

16. The container according to 1, wherein:

in a transition region between an end portion and a receiving portion of ones of the grooves, a securing web running transversely with respect to a longitudinal extension of said grooves is provided.

17. The container according to claim 1, wherein:

the container body is a bottle body and the at least one connection part comprises a sleeve cap configured for fastening a bottle teat.

18. The container according to claim 17, wherein:

the bottle body comprises two connection openings lying opposite one another, with an upper connection opening for fastening the bottle teat and a bottom connection opening for fastening a connection part constituted as a bottom cap with an air intake valve.

19. The container according to claim 17, wherein:

an annular cap portion of the sleeve cap comprises at least one projecting web, subdivided into four portions, at an underside facing towards the container body in an assembled position.

20. A bottle teat for a container according to claim 1, wherein:

the bottle teat comprises, in an end portion lying opposite a suction opening, a cylindrical portion with a larger inner diameter than the outer diameter of the container body adjacent to the upper connection opening;

the cylindrical portion comprises a sealing lip projecting inwards at an end.

21. The bottle teat according to claim 20, wherein:

the cylindrical portion comprises a circumferential annular web projecting upwards in a direction of the suction opening.

22. The bottle teat according to claim 20, wherein:

in a flange-shaped end portion lying opposite the suction opening at the upper side facing the suction opening, the bottle teat comprises a groove-shaped recess running corresponding to an edge of the upper connection opening of the container.

23. An insertion part for a container according to claim 1, wherein:

the insertion part in an outer end portion comprises a cylindrical portion with a greater inner diameter than the outer diameter of the container adjacent to a bottom connection opening;

wherein the cylindrical portion comprises an inwardly projecting sealing lip at an end.

24. The insertion part according to claim 23, wherein:

the insertion part comprises, in a bottom flange-shaped end portion at an underside facing a connection part when in use, a groove-shaped recess, running corresponding to an edge of a lower connection opening of the container.

* * * * *